United States Patent [19]

Tomiyama et al.

[11] 3,948,818

[45] Apr. 6, 1976

[54] DETERGENT COMPOSITION

[75] Inventors: Shinichi Tomiyama, Ichikawa; Masahide Iimori, Tokyo, both of Japan

[73] Assignee: Lion Fat & Oil Co., Ltd., Tokyo, Japan

[22] Filed: May 16, 1974

[21] Appl. No.: 470,373

[30] Foreign Application Priority Data

May 21, 1973 Japan ..... 48-56556

[52] U.S. Cl. ..... 252/542; 252/526; 252/545; 252/546; 260/534 L

[51] Int. Cl.[2].... C11D 1/10; C11D 3/33; C11D 3/34

[58] Field of Search ..... 252/545, 526, 546, 542; 260/534 L

[56] References Cited

UNITED STATES PATENTS

| | | | |
|---|---|---|---|
| 3,590,001 | 6/1971 | Taylor et al. | 252/135 X |
| 3,635,829 | 1/1972 | Yang | 252/526 |
| 3,762,859 | 10/1973 | Wixon et al. | 252/545 X |
| 3,779,933 | 12/1973 | Eisen | 252/546 X |
| 3,787,337 | 1/1974 | Goodwin | 252/545 |

*Primary Examiner*—Thomas J. Herbert, Jr.
*Attorney, Agent, or Firm*—Woodhams, Blanchard and Flynn

[57] ABSTRACT

A detergent composition which is mainly composed of a salt of basic amino acid of a surface activity-having organic sulfonic acid or organic ester sulfate, and is possessed of an extremely low virulence especially to marine products.

7 Claims, No Drawings

DETERGENT COMPOSITION

BACKGROUND OF THE INVENTION

1. Field of the invention

The present invention relates to a detergent composition which is possessed of an excellent detergency and is extremely low in the toxicity, in particular, to marine life.

2. Description of the prior art

Conventional detergents have been said to exert a detrimental influence on marine life in rivers, the sea and so forth when waste waters containing said detergents flow into rivers, lakes, marshes, the sea etc. whereby the active components contained therein such as surface active agent and the like are highly concentrated.

From the view point of preserving the environment in good condition, detergents free from phosphates, of course, have been used recently. However, this is effective only to prevent the extraordinary breeding of algae, but it is insufficient as a fundamental reform measure to improve the living conditions of marine life. Such being the case, there has been a strong cry for development of detergents which are harmless to marine life.

SUMMARY OF THE INVENTION

The object of the present invention is to provide a detergent which is possessed of an excellent detergency and at the same time is entirely free from or, if any, is extremely low in a marine life-poisoning property. By the words used herein "marine life-poisoning property" is meant a property to bring about a detrimental and undesirable result on marine life. Hence, for instance the words "low marine life-poisoning property" imply that the detergent is low in toxicity to marine life.

The present invention is concerned with a detergent composition having a low marine life-poisoning property which is mainly composed of a salt of basic amino acid of a surface active-bearing organic sulfonic acid or organic ester sulfate. In other words, the detergent composition according to the present invention is characterized in that in the sulfonic acid-type ($—SO_3H$) or ester sulfate-type ($—O—SO_3H$) anionic surface active agent, which is the active constituent of said detergent composition, the cationic part of said active constituent consists of a basic amino acid.

Among the constituents (active constituents) of the detergent according to the present invention, the moiety constituting its anionic part is, for instance, either an organic sulfonic acid such as alkylbenzene sulfonic acid having 8 to 18 carbon atoms, alkane sulfonic acid having 14 to 22 carbon atoms, alkene sulfonic acid having 14 to 22 carbon atoms, sulfonate of fatty acid having 8 to 22 carbon atoms or its lower alcohol ester etc.; or an organic ester sulfate such as monohydric alcohol monoester sulfate having 10 to 22 carbon atoms and so forth. The above-enumerated are typical members constituting the anionic moiety, but are limited only thereto. And, derivatives thereof are also usable in the present invention so far as their use does not deviate from the object of the present invention.

On the other hand, among the constituents (active constituents) of the detergent according to the present invention, a member constituting the cationic moiety is a basic amino acid such as lysine, hydroxylysine, arginine, histidine, ornithine etc.

In the actual manufacture of the aforesaid detergent constituent (a salt of basic amino acid as active constituent) it can be obtained by mixing an acid type detergent constituent, that is, for instance said alkylbenzene sulfonic acid, in the liquid state with said basic amino acid and stirring the resulting mixture. This reaction is carried out at room temperature.

Referring to the detergent composition according to the present invention, as constituents other than the above mentioned salt of basic amino acid to be incorporated into said detergent composition there can be enumerated conventional detergent constituents, for instance, alkali inorganic builders such as sodium silicate, sodium pyrophosphate, sodium tripolyphosphate etc.; neutral inorganic builders such as sodium sulfate etc.; solubilizers such as ethanol, toluene sodium sulfonate etc.; performance improving agents such as triethanol-amine, amine oxide etc.; perfume, fluorescent breaching agents; coloring matter; and so forth. It is especially when the weight ratio of the salt of basic amino acid to the alkali inorganic builder is in the range of 1:0.5–5 that excellent detergency, foamability and foam-stability are obtainable and further a low marine life-poisoning property can be maintained. Of course therein may be incorporated a suitable surface active agent other than the salt of basic amino acid.

The detergent composition according to the present invention essentially comprises one or two kinds or more of the specific salts of basic amino acid. The proportion of the salt of basic amino acid in the detergent composition, though not so strictly limited, is preferred to be in the range of from 10 to 30% by weight. In case the proportion is less than 10% by weight there can not obtained a sufficient detergency, and contrary to this, even when the proportion is in excess of 30% by weight there can be observed not so much improvement in effect owing to an increase in quantity. The proportion of the salt of basic amino acid, if another surface active agent be used together, may sufficiently be small, but taking into consideration the marine life-poisoning property the use of other surface active agent in a large quantity should be said to be undesirable.

The detergent composition accordiing to the present invention can take optional configurations, for instance, powdery, granular, flaky, massive, liquid and so forth.

DESCRIPTION OF THE PREFERRED EMBODIMENTS

Examples 1 to 13 and Control Examples 1 to 2

The marine life-poisoning property (TLM value) of each detergent constituent is shown in Table-1.

Table-1

| | | | TLM value (ppm)* |
|---|---|---|---|
| Example | 1 | lysine salt of straight-chain dodecylbenzene sulfonic acid | 25 |
| " | 2 | hydroxylysine salt " | 20 |
| " | 3 | arginine salt " | 100 |
| " | 4 | histidine salt " | 45 |
| " | 5 | ornithine salt " | 30 |

Table-1-continued

| | | | TLM value (ppm)* |
|---|---|---|---|
| " | 6 | mixed basic amino acid salt of straight-chain dodecylbenzene sulfonic acid** | 25 |
| Control Example | 1 | straight-chain sodium dodecylbenzene sulfonate | 4 |
| " | 2 | straight-chain ammonium dodecylbenzene sulfonate | 4 |
| Example | 7 | lysine salt of $C_{15-18}$ mixed alkane sulfonic acid | 25 |
| " | 8 | mixed basic amino acid salt of $C_{15-18}$ mixed alkane sulfonic acid** | 25 |
| " | 9 | arginine salt of hydroxy hexadecane sulfonic acid | 70 |
| " | 10 | arginine salt of hexadecene sulfonic acid | 60 |
| " | 11 | mixed basic amino acid salt of hexadecene sulfonic acid** | 25 |
| " | 12 | arginine salt of lauryl alcohol sulfuric ester | 100 |
| " | 13 | mixed basic amino acid salt of lauryl alcohol sulfuric ester** | 25 |

*In accordance with JIS K 0102 (1971), Japanese gold fishes (a kind of gold fish) were kept in the active constituent-containing water for 24 hours and then the active constituent concentration (TLM value) measured at the time when 50% of the tested gold fishes survived was expressed in terms of ppm.

**The mixed basic amino acid comprises 40% by weight of lysine, 30% by weight of arginine and 30% by weight of histidine.

Example 14 and Control Example 3

A 0.167% aqueous solution of the detergent having the following composition was subjected to a detergency test and the thus obtained results are shown in Table-2. The constituents of the detergent according to the present invention were recognized to be not inferior in detergency as compared with the straight-chain sodium dodecylbenzene sulfonate which was publicly known as one of the detergent constituents being most excellent in detergency.

Table-2

| | | Example 14 | Control Example 3 |
|---|---|---|---|
| Composition (wt.%) | straight-chain dodecylbenzene sulfonic acid lysine salt | 20 | — |
| | straight-chain dodecylbenzene sulfonic acid sodium salt | — | 20 |
| | sodium silicate | 15 | 15 |
| | sodium carbonate | 5 | 5 |
| | sodium sulfate | 56 | 56 |
| | CMC | 1 | 1 |
| | water | 3 | 3 |
| Detergency | (By employing artificial sebum soil detergency test procedure)*** | 83 | 85 |

*** The artificial sebum soil detergency test procedure is conducted as follows.

The following organic constituents are heated at 60° to 80°C and mixed together. After leaving the resulting mixture stand to thereby cool it down to room temperature, an inorganic constituent, clay, is added thereto, and the mixture is further mixed by the use of a mortar.

-continued

| | | |
|---|---|---|
| | myristic acid | |
| | oleic acid | |
| | tristearin | |
| | triolein | |
| organic soil | cholesterol | |
| | cholesterol stearate | |
| | paraffin wax | |
| | squalene | |
| inorganic soil | Clay: | obtained by drying "Shimosueyoshi" loam at 800°C for 3 hours, crushing thereafter and passing 325-mesh. |
| organic soil / inorganic soil | | 49.75/49.75/0.5 |
| | carbon black | |

By putting a small dose of the soil on a sponge and spreading it uniformly on a desized No. 60 cotton broadcloth (manufactured by KANEBO K.K.) not subjected to fluorescent dying to soil it to such an extent that it will attain a reflectance of 42 ± 2% as measured with Elrepho-model photoelectric reflectance meter manufactured by CARLZEISS CO., further rubbing the thus soiled cloth with a clean sponge and cutting said soiled cloth into pieces of 5 cm × 5 cm each, test pieces of soiled cloth are prepared.

10 pieces of soiled cloth prepared as above are subjected to 10 minutes' cleansing by the use of Terg-O-Tometer (U.S. Testing Co.) under the conditions of bath volume: 900 cc, bath temperature: 25°C, agitating speed: 150 c.p.m., bath ratio: X30.

For the purpose of adjusting the bath ratio, there is employed cloth having 0.6% of organic constituent of an artificial soil attached thereto.

Rinsing is effected for 3 minutes under the same condition as in the case of washing. The detergency is computed by applying the following equation upon measuring the reflectance of the soiled cloth before and after washing.

$$\text{Detergency } (\%) = \frac{Rw - Rs}{Ro - Rs} \times 100$$

(wherein

*Ro* represents the reflectance (%) of clean cloth,

*Rs* represents the reflectance (%) of soiled cloth before washing, and

*Rw* represents the reflectance (%) of soiled cloth after washing.)

What is claimed is:

1. In a detergent composition consisting essentially of surfactant component and builder component, the improvement which comprises: said detergent composition contains, as a surfactant component, from 10 to 30 percent by weight, based on the weight of said detergent composition, of at least one salt selected from the group consisting of the lysine, hydroxylysine, arginine, histadine and ornithine salts of alkylbenzene sulfonic acids having 8 to 18 carbon atoms, alkane sulfonic acids having 14 to 22 carbon atoms, alkene sulfonic acids having 14 to 22 carbon atoms, sulfonates of fatty acids having 8 to 22 carbon atoms and lower alcohol esters thereof, and monohydric alcohol monoester sulfates having 10 to 22 carbon atoms.

2. A detergent composition according to claim 1 in which said builder component comprises an alkaline inorganic builder, and the weight ratio of said salt: said alkaline inorganic builder is 1 : 0.5 to 5.

3. A detergent composition according to claim 1 in which said salt is a salt of alkylbenzene sulfonic acids having 8 to 18 carbon atoms.

4. A detergent composition according to claim 1 in which said salt is a salt of alkane sulfonic acids having 14 to 22 carbon atoms.

5. A detergent composition according to claim 1 in which said salt is a salt of alkene sulfonic acids having 14 to 22 carbon atoms.

6. A detergent composition according to claim 1 in which said salt is a salt of sulfonates of fatty acids having 8 to 22 carbon atoms and lower alcohol esters thereof.

7. A detergent composition according to claim 1 in which said salt is a salt of monohydric alcohol monoester sulfates having 10 to 22 carbon atoms.

* * * * *